United States Patent [19]

Fecko

[11] 4,001,958

[45] Jan. 11, 1977

[54] "TAKE-ONE" DISPLAY CARD

[75] Inventor: Francis D. Fecko, Aurora, Ohio

[73] Assignee: The A. L. Garber Company, Ashland, Ohio

[22] Filed: Mar. 29, 1976

[21] Appl. No.: 671,499

[52] U.S. Cl. ..... 40/124.1; 40/126 A; 248/459

[51] Int. Cl.[2] ..... G09F 1/06

[58] Field of Search ..... 40/124.1, 126 A, 152.1; 206/462, 45.24–45.27; 428/459; 211/73

[56] References Cited

UNITED STATES PATENTS

| | | | |
|---|---|---|---|
| 814,706 | 3/1906 | Isacke | 40/126 A |
| 1,515,741 | 11/1924 | Lyons | 206/45.26 X |
| 2,304,209 | 12/1942 | Rossiter | 40/126 A X |
| 3,545,115 | 12/1970 | Nichols | 40/124.1 |
| 3,739,511 | 6/1973 | Freedman | 40/124.1 |

*Primary Examiner*—John F. Pitrelli
*Attorney, Agent, or Firm*—Axel H. Johnson

[57] ABSTRACT

A display card having a rearwardly-positioned foot to maintain the card in an upright position, and a forwardly-positioned pocket to hold material for distribution. The card comprises a front display-panel portion with the pocket formed therefrom, and a rear panel portion with the foot formed therefrom. The front panel and rear panel comprise a unitary sheet folded so as to permit the contiguous positioning of the panels in back-to-back relationship, and finally securing them in integrally together by suitable means.

2 Claims, 8 Drawing Figures

"TAKE-ONE" DISPLAY CARD

BACKGROUND OF THE INVENTION

1. Field of the Invention

This invention relates to a display card to be positioned upright, the purpose of which is to advertise a product or a service, and to include advertising material inserted in a pocket for distribution.

2. Description of the Prior Art

The Prior Art includes easels and stands for displaying products for sale in a manner to attract buyers.

SUMMARY OF THE INVENTION

The display card of this invention comprises a unitary sheet of suitable material having a central fold defining a front panel and a rear panel. The front panel is provided with a pocket formed therefrom, and the rear panel is provided with a foot formed therefrom: The result being a display card with all elements embraced in a single sheet of material.

An object of this invention is to provide a Display Card that comprises a single sheet folded in equal superposed panels, and having a pocket on one panel and a leg on the other panel: The pocket and leg being formed integrally with the sheet so no individual production of separate parts is required, thus dispensing with the expense of final assembly.

Referring to the drawings.

Figure 1:
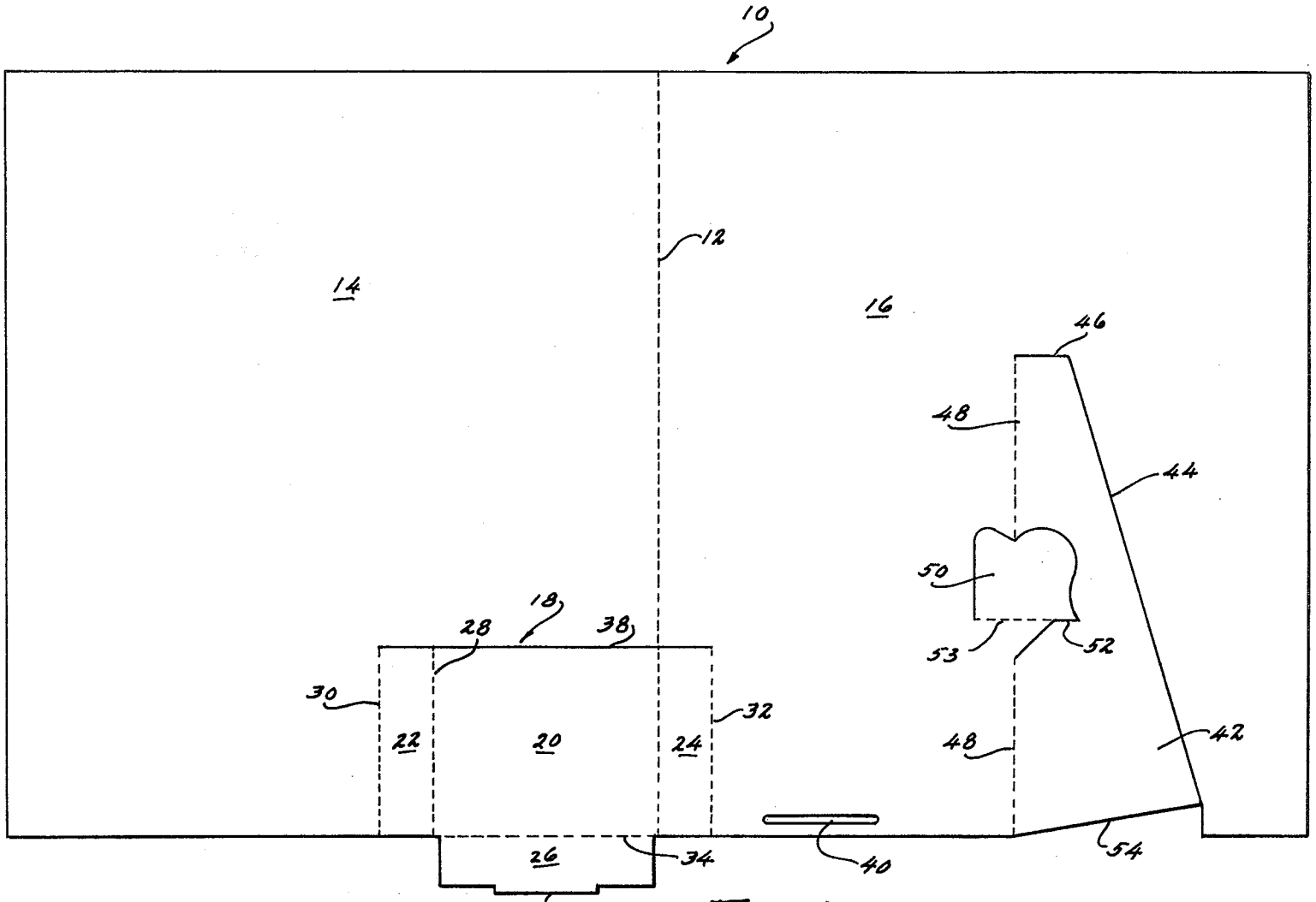
FIG. 1 is a view of the sheet prior to forming.
Figure 2:
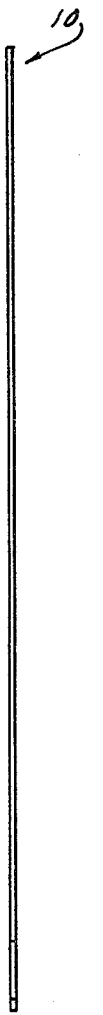
FIG. 2 is an edge view of the sheet of FIG. 1.
Figure 4:
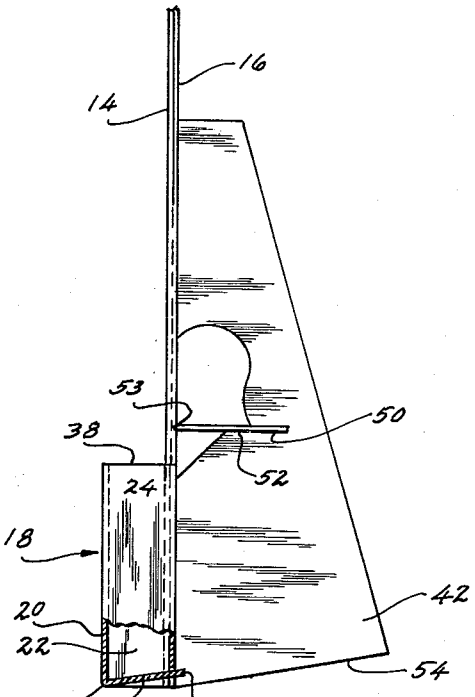
FIG. 4 is an edge view of the card showing the pocket and foot after being formed.
Figure 6:
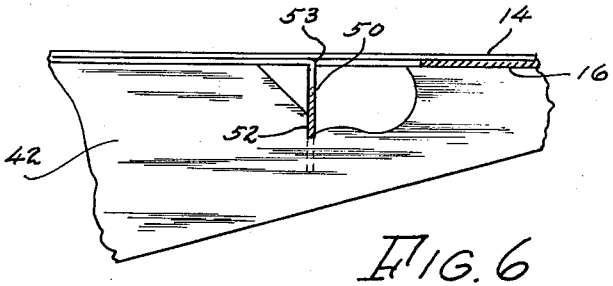
FIG. 6 is a section taken at 6—6 of FIG. 5.
Figure 3:
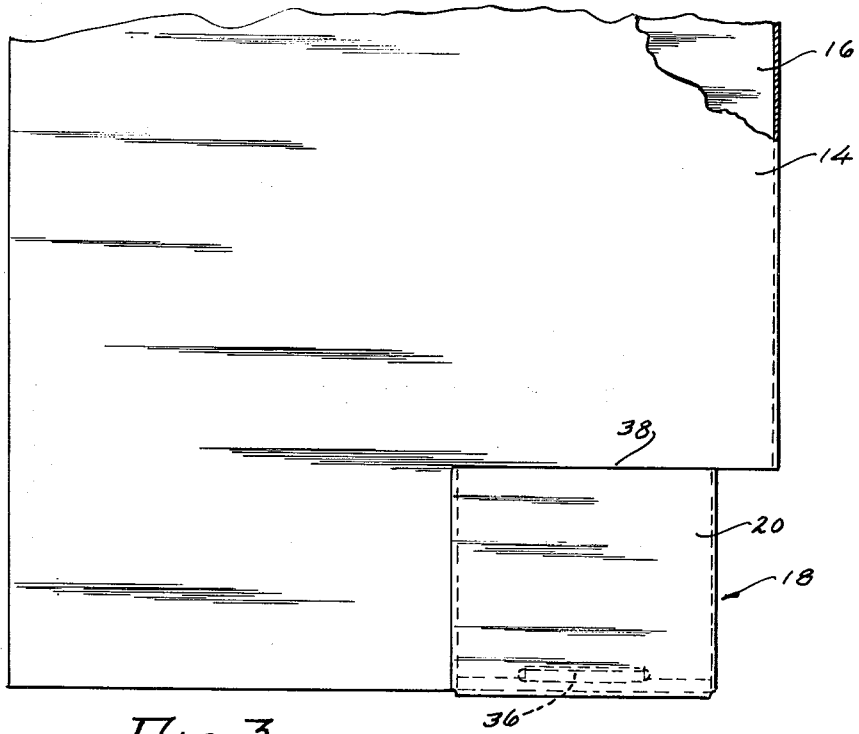
FIG. 3 is a front view of the card showing the manner of forming the pocket.
Figure 5:
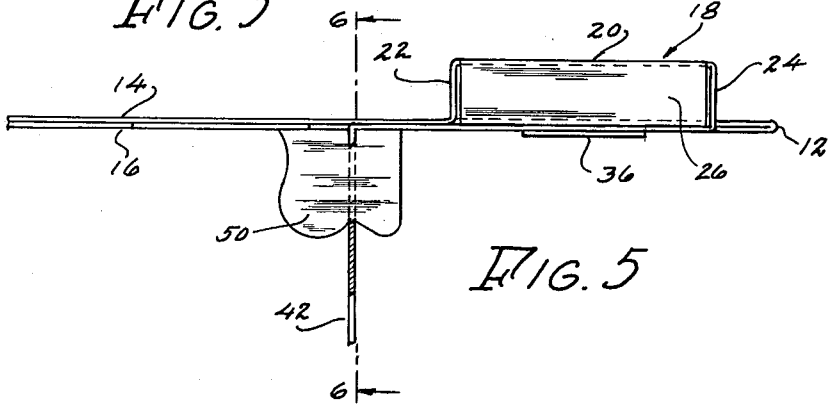
FIG. 5 is a projection of FIG. 3 with portions removed.
Figure 7:
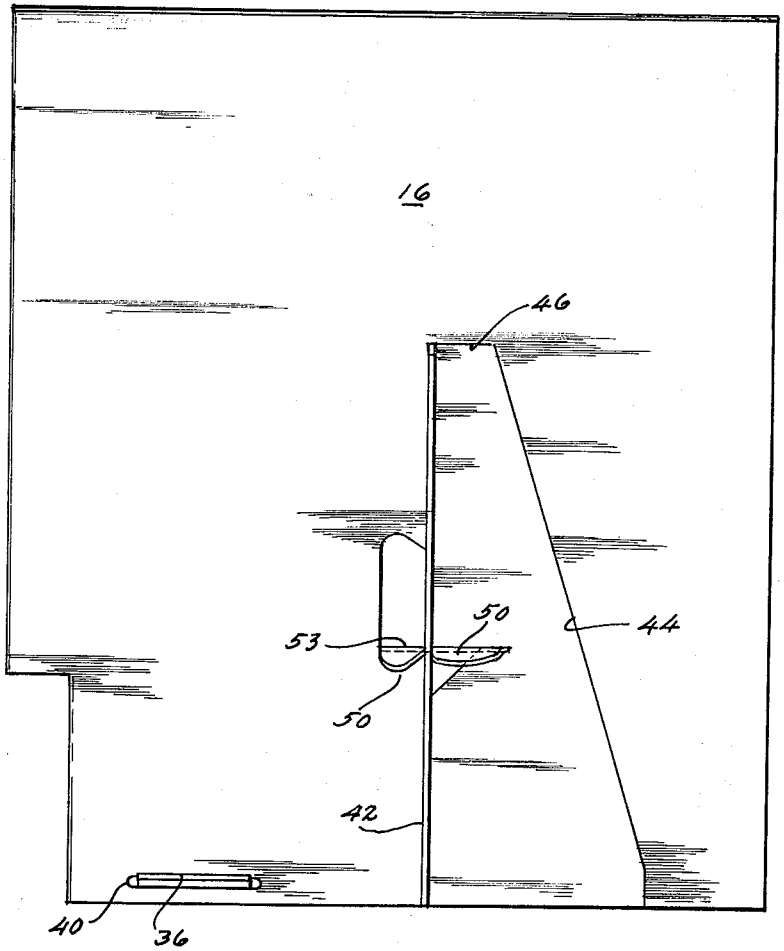
FIG. 7 is a rear view of the completed card and positioned on a horizontal surface.
Figure 8:
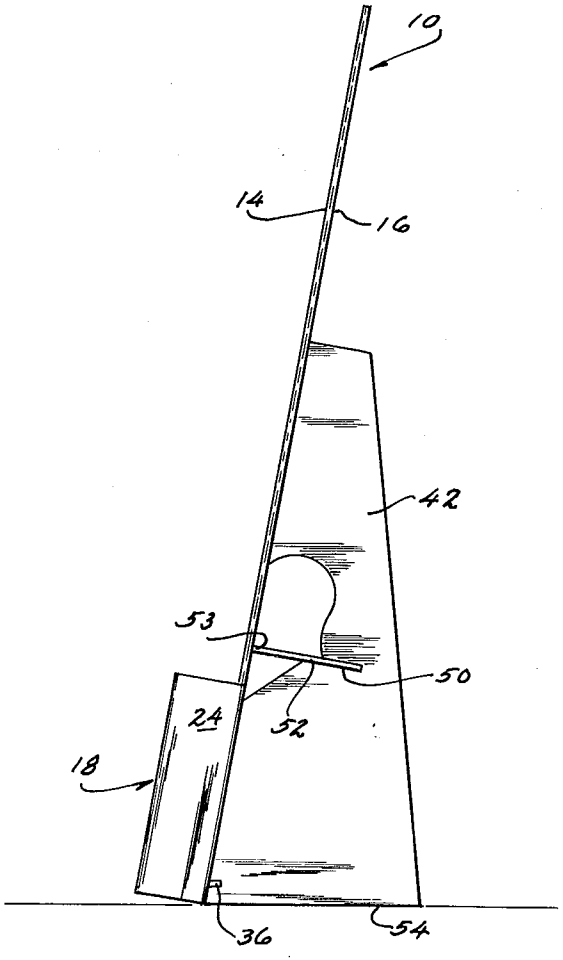
FIG. 8 is an edge-wise view of the card of FIG. 7.

The preferred construction of the blank is shown in FIG. 1, and comprises a sheet 10 of a suitable material and thickness. An impressed hinge line 12 divides sheet 10 into equal front and rear panels 14 and 16. Pocket 18 comprises a front panel 20, side panels 22 and 24, and a bottom panel 26. Pocket 18 is defined by a hinge 12 and 28, and hinge lines 30, 32 and 34 comprising spaced perforations. Bottom panel 26 has integral therewith a lug 36 for a purpose which will appear. Upper edge 38 of the pocket 18 is provided by piercing the sheet 10 between hinge lines 30 and 32. A slot 40 is provided in panel 16 to receive lug 36 when the card is folded so that panels 14 and 16 are contiguously back-to-back. Foot 42 is defined in rear panel 16 by pierced lines 44 and 46. A hinge line 48 establishes a means to position foot 42 normal to the panel 16 as shown in FIG. 5. A tongue 50 of the contour shown is formed in panel 16 and defined by a pierced outline. Tongue 50 is hinged as at 53 so as to position the tongue 50 in engagement with a stop portion 52 as shown in FIGS. 4 through 8, so as to lock foot 42 in position. The lower edge of foot 42 is of an angle relative to hinge line 48 to assure that the card will be positioned in an upright position, as shown at 54.

When preparing the card for display, panels 14 and 16 are folded at line 12 so that the rear surfaces thereof are in Mutual contact. Pocket 18 is then prepared by positioning side panels 22 and 24 upwardly about hinge lines 12, 28, 30 and 32, as shown in FIGS. 1, 3 through 5. Bottom panel 26 is formed about hinge line 34 with lug 36 inserted in slot 40 of rear panel 16. The rear mutually-contacting surfaces of panels 14 and 16 are now to be secured together by a suitable means in a manner shown in FIGS. 3 through 6.

The above being a complete description of an illustrative embodiment of the invention, what is claimed and desired to be secured by Letters Patent of the United States is:

1. A display card having all elements thereof embraced in a single sheet of material and folded to form a front panel and a rear panel, said panels being positioned in contiguous back-to-back relationship, a pocket positioned forwardly and normal to said front panel and formed from said sheet and defined by folds in said rear panel and said front panel, said pocket having a bottom panel formed substantially normal to said front panel, and means on said bottom panel to secure said bottom panel to said rear panel; a foot formed from said back panel, hinged thereto and having a free edge, and being positioned substantially normal to said back panel, said front and back panels secured back-to-back by a suitable means.

2. A display card as set forth in claim 1, in which said rear panel has a tongue formed therefrom to secure said foot substantially normal to said back panel.

* * * * *